US007437840B2

(12) United States Patent
Ratmansky et al.

(10) Patent No.: US 7,437,840 B2
(45) Date of Patent: Oct. 21, 2008

(54) MEMORABILIA APPARATUS

(76) Inventors: Paul Phillip Ratmansky, 539 Fernon St., Philadelphia, PA (US) 19148; Joel David Ratmansky, 539 Fernon St., Philadelphia, PA (US) 19148

( * ) Notice: Subject to any disclaimer, the term of this patent is extended or adjusted under 35 U.S.C. 154(b) by 222 days.

(21) Appl. No.: 11/284,073

(22) Filed: Nov. 18, 2005

(65) Prior Publication Data

US 2006/0101676 A1 May 18, 2006

(51) Int. Cl.
*G09F 3/02* (2006.01)

(52) U.S. Cl. ..... 40/27.5; 40/587; 40/323; 206/0.8; 206/0.81; 206/0.82

(58) Field of Classification Search ..... 40/27.5, 40/587, 323, 661.05; 301/37.101, 37.26, 301/37.109; 446/88; D21/548, 561; 206/0.8, 206/0.81, 0.82
See application file for complete search history.

(56) References Cited

U.S. PATENT DOCUMENTS 2,467,043 A 4/1949 Kotler
2,569,212 A * 9/1951 Zagotti ..... 40/587
2,704,211 A 3/1955 Decepoli
3,481,652 A * 12/1969 Mazerolle ..... 301/37.26
3,953,932 A 5/1976 Graves
4,441,762 A * 4/1984 Segal ..... 301/37.105
4,534,185 A * 8/1985 Berry et al. ..... 63/14.3
4,940,441 A 7/1990 Novlnsky
5,058,959 A * 10/1991 Miles et al. ..... 301/108.2
5,092,806 A * 3/1992 Brown ..... 446/88
5,316,376 A * 5/1994 Defreitas ..... 301/37.26
5,697,858 A 12/1997 Lekavich
6,217,468 B1 4/2001 Goodwin
6,248,034 B1 6/2001 Voloshen
6,309,027 B1 * 10/2001 Smith ..... 301/37.109
2001/0036877 A1 11/2001 Hartman

FOREIGN PATENT DOCUMENTS

EP 458203 A2 * 11/1991

OTHER PUBLICATIONS

Translation of EP 458203 A2.*

* cited by examiner

*Primary Examiner*—Gary C Hoge
(74) *Attorney, Agent, or Firm*—Robert J. Yarbrough

(57) ABSTRACT

The Invention is a memorabilia apparatus. Indicia are imprinted on a medallion using convention minting technology. An ice hockey puck or a model of a tire has a cavity adapted to receive and to support the medallion for display. The cavity of the puck or model of a tire exerts a pre-selected force upon the medallion over a pre-selected area, holding the medallion in place during handling while allowing a collector to release the medallion from the puck or model of the tire. Alternatively, resilient or spring retaining members releasably engage the puck or model of the tire and the medallion.

5 Claims, 12 Drawing Sheets

32

MEMORABILIA APPARATUS

BACKGROUND OF THE INVENTION

1. Field of the Invention

The invention is a memorabilia apparatus. The memorabilia apparatus of the Invention is a "collectable," that is, an object designed to appeal to a collector, relating specifically to the sport of ice hockey, or to vehicles, vehicle tires or vehicle sports generally. The apparatus generally comprises an ice hockey puck or a model of a tire releasably receiving a medallion or medallions for display.

2. Description of the Related Art

Sports memorabilia are popular among collectors and fans. In addition to the baseball cards and autographed baseballs of the past, collectors and fans are interested in many items bearing the logo of a favorite team or the name of a favorite player. For example a reproduction hockey jersey bearing the name and number of a popular player is much sought after by fans.

Collectables have long been popular. Collectors have a particular affinity for collectables relating to an interest of the collector, such as a make of automobile or particular class of automobile racing, such as NASCAR. A collectable may address any other item of interest to the collector.

SUMMARY OF THE INVENTION

The present invention extends the range of collectables for the sport of ice hockey and for motor sports, including automobile racing. The present Invention also addresses collectables for any interest involving tires, including without limitation automobiles, motorcycles, trucks, bicycles, aircraft, skates, skateboards and any other use of tires, particularly tires composed of rubber or other resilient material.

The Invention comprises a hockey puck or a model of a tire. A cavity appears in the hockey puck or model of the tire and a medallion composed of a precious metal or other material is inserted into the cavity. Indicia appear on the medallion embossed by conventional minting or coining technology. The indicia may comprise a team or league logo, the image of a player, driver, automobile, trophy, stadium, race track, a motto, or any other indicia. The medallion is removable from the cavity in the puck or model of the tire and one medallion may be changed for another by the collector. The medallion may have two sides and indicia may appear on both sides.

Means are presented for allowing the medallions to be removably retained in the cavity, comprising configurations of a hockey puck or a model of a tire. Other means include a retaining member adapted to be inserted into the hockey puck or model of a tire, the retaining member being adapted to receive a variety of medallions. The means for releasably retaining the medallion allow the force exerted upon the medallion to be pre-selected and allow the surface area in contact with the medallion to be pre-selected. The means for releasably retaining the medallion in the cavity therefore allow the ease or difficulty of removing and replacing the medallion to be pre-selected. The surface area in contact with the medallion and the force exerted on the medallion by the puck, model of the tire, or the retaining member are selected so that the medallion is securely retained in the cavity for display but may be readily removed by the collector.

Multiple medallions and multiple cavities in the puck or model of the tire may be utilized. Display means for the hockey puck, model of the tire and medallion also are included as a part of the disclosure.

DESCRIPTION OF AN EMBODIMENT

Figure 1:
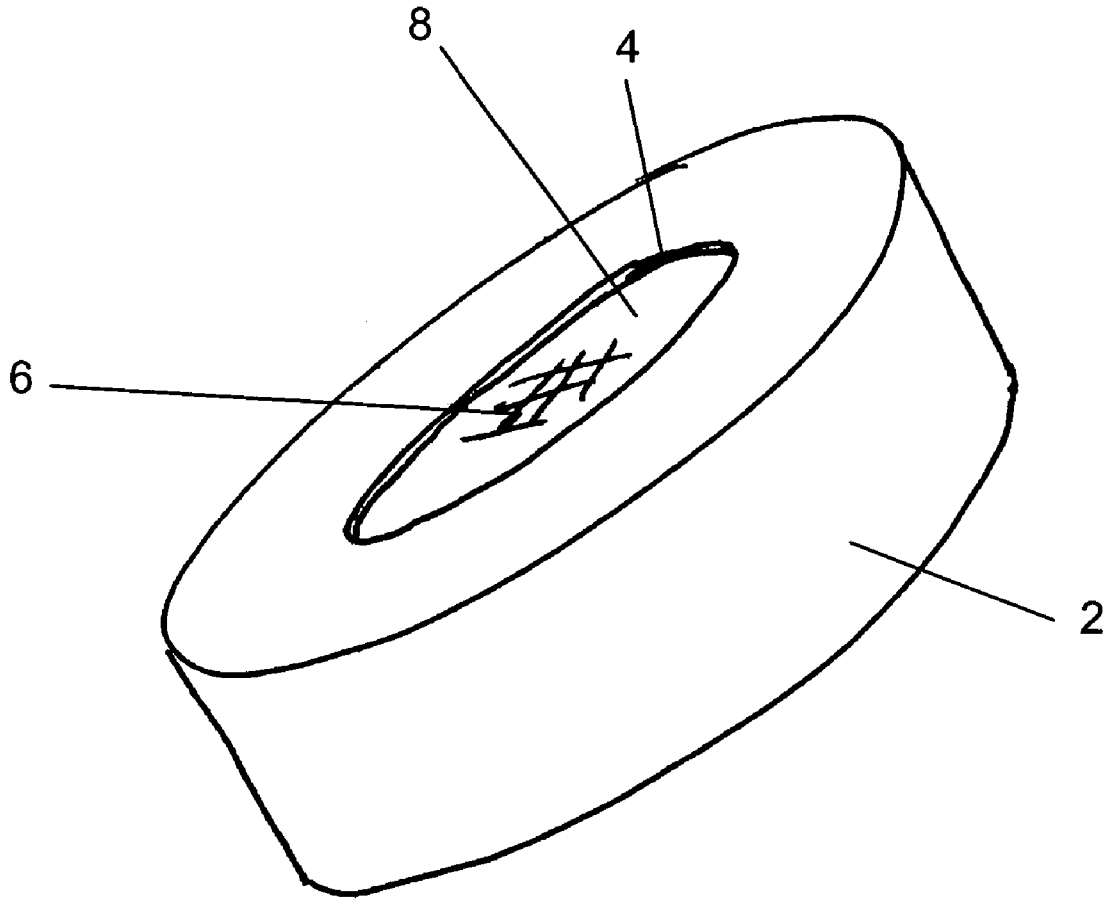
FIG. 1 is a perspective view of a hockey puck and medallion combination.

FIG. 1 illustrates the ice hockey puck 2 embodiment of the Invention. An ice hockey puck 2 has inset into its surface a medallion 4. Medallion 4 bears indicia 6. The indicia 6 are embossed onto the display surface 8 of the medallion 4 using conventional minting or coining technology, including impact or pressure technologies such as knuckle presses or hydraulic presses. Alternatively, any means known in the art may be used to impart indicia 6 to medallion 4, including without limitation printing, coating, painting, engraving, ablating, welding, depositing, carving, turning, milling, cutting, laser cutting, casting and molding. Indicia 6 may appear on both sides of the medallion 4 and different indicia 6 may be used for each side. The indicia 6 preferably are designs, such as a relief design, impressed into the surface of medallion 4. Indicia 6 preferably relates to the sport of ice hockey. Indicia 6 may comprise anything in which a hockey fan or collector of hockey memorabilia might take an interest, such as a team or league logo, the likeness of a place or person, the date of a victory or tournament, the likeness of a trophy or prize, or any other indicia 6.

Medallion 4 may be composed of a precious metal, but any material for medallion 4 is contemplated by the invention. For example, medallion 4 may be composed of wood, ceramic, synthetic plastics, or any other material. While embossing using minting technology is preferred, the invention contemplates any method for imparting indicia 6 to the medallion 4.

The puck 2 is comprised generally of a somewhat resilient material, such as a hard rubber. The puck 2 may be a new puck 2 approved for play by the applicable hockey league. The puck 2 may be one that has had specific uses, such as a puck 2 used in practice by a specific team or player, a puck 2 used in a game, or a puck 2 used in a tournament. The puck 2 may be one handled by a particular player.

Pucks 2 and medallions 4 may be offered in specific series, such as the practice series, game series and tournament series using practice pucks 2, game pucks 2 and tournament pucks 2, respectively.

The puck 2 may be a facsimile of a league-approved hockey puck 2 produced specifically for the purpose of displaying the medallions 4 of the Invention. The materials from which the puck 2 is composed may be selected to properly retain the medallion 4 in the puck 4 while allowing the fan or collector of memorabilia to remove readily the medallion 4 at will.

Figure 2:
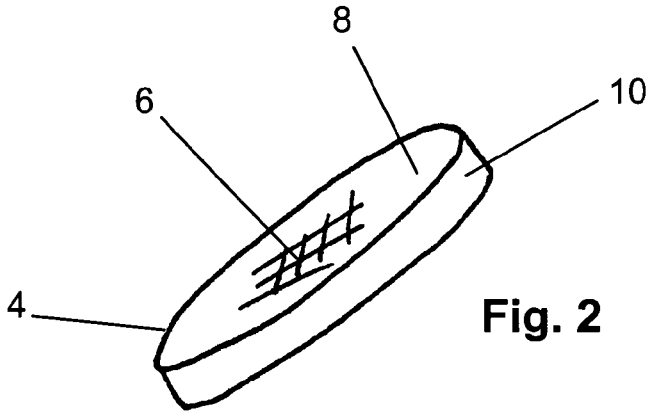
FIG. 2 is a perspective view of a medallion.
Figure 3:
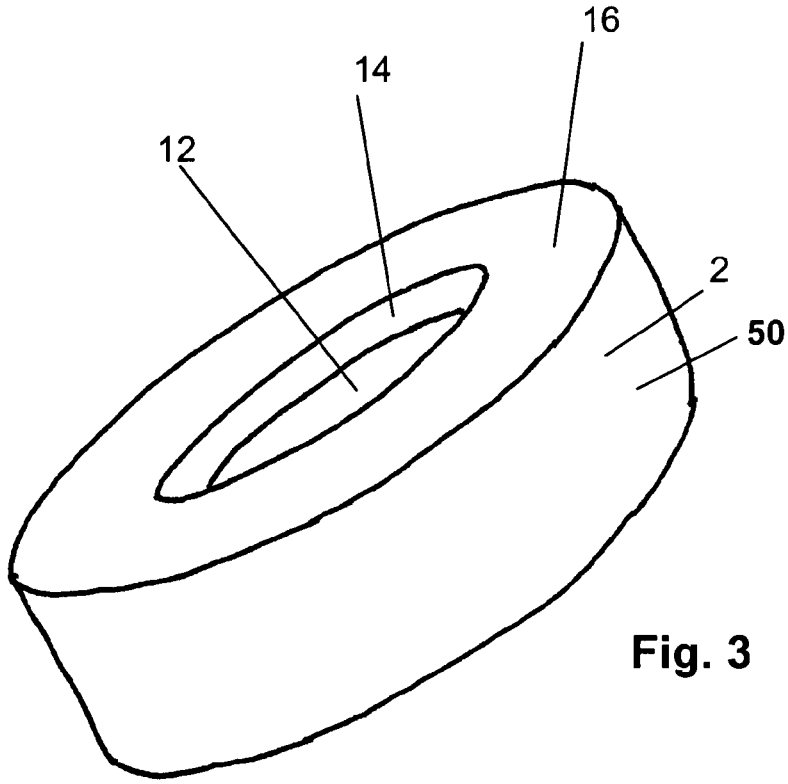
FIG. 3 is a perspective view of a hockey puck or model tire prepared to accept the medallion.

FIG. 2 shows a medallion 4 removed from puck 2. As shown by FIG. 3, a cavity 12 is prepared in puck 2 to receive medallion 4. The cavity 12 releasably retains medallion 4. The fan or collector may remove the medallion 4 at any time and replace the medallion 4 in puck 2 with another medallion 4, thereby allowing the fan or collector to display multiple medallions 4 without also displaying multiple pucks 2.

Figure 4:
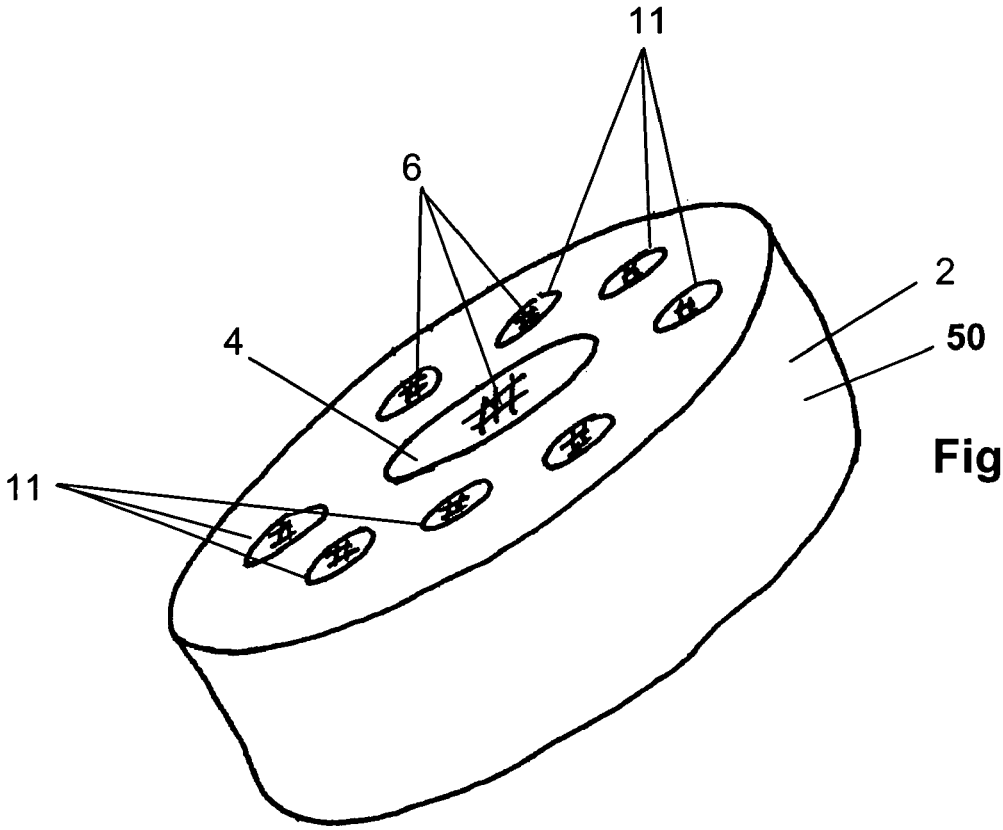
FIG. 4 is a perspective view of a hockey puck or model tire combined with a plurality of medallions.

As shown by FIG. 4, each puck 2 alternatively may display a plurality of medallions 4, each bearing indicia 6. For example, a large medallion 4 may connote a hockey team and each small medallion 11 may connote a victory of the team, or a starting player on the team.

Figure 5:
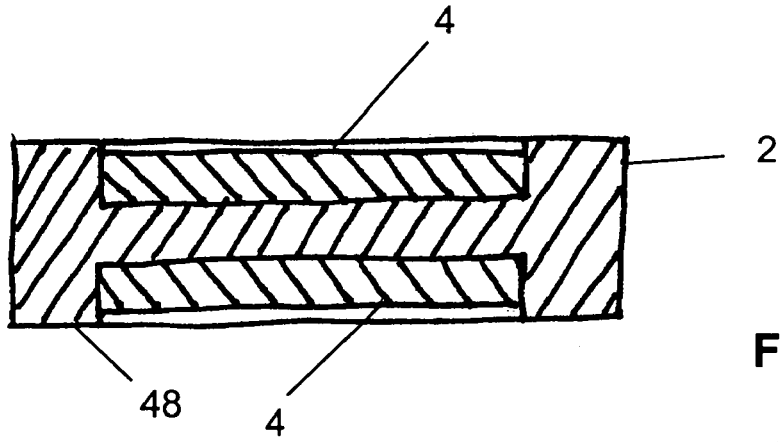
FIG. 5 is a cross section view showing a puck or model tire with a medallion on both flat sides of the puck or model tire.

Medallions 4 may be displayed on each of the flat sides of the puck 2, as shown by FIG. 5. In FIG. 5, a medallion 4 appears on one side of puck 2. Another medallion 4 appears on the reverse side 48 of puck 2. For example, a medallion 4 on a first side of puck 2 may bear indicia indicating a team and a medallion 4 on the reverse side 48 of puck 2 may bear indicia indicating a player.

Figure 6:
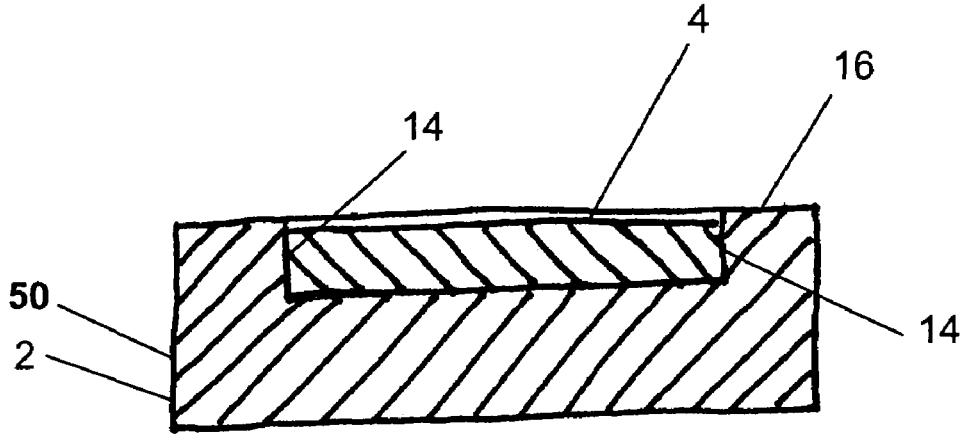
FIG. 6 is a cross section view showing a first means for retaining the medallion in the puck or model tire.

The medallion 4 may be released from the puck 2 by the fan or collector so that another medallion 4 may be inserted in the puck 2. FIG. 6 illustrates a first means for releasably holding medallion 4 by puck 2. The cavity 12 (FIG. 3) may be cut or molded into the puck 2. Cavity 12 has interior surface 14 that is perpendicular to the sides of the puck 2. The medallion 4 has an exterior surface 10 (FIG. 2) that is perpendicular to the display surface 8 of the medallion 2. The exterior surface 10 of the medallion 4 engages the interior surface 14 of cavity 12 with a sliding fit, so that medallion 4 is retained in puck 2 during ordinary handling. Tolerances and construction of puck 2 and medallion 4 may be set during manufacture so that the fan or collector may easily release medallion 4 from puck 2, may release medallion 4 with difficulty from puck 2 or may not release medallion 4 from puck 2.

Figure 7:
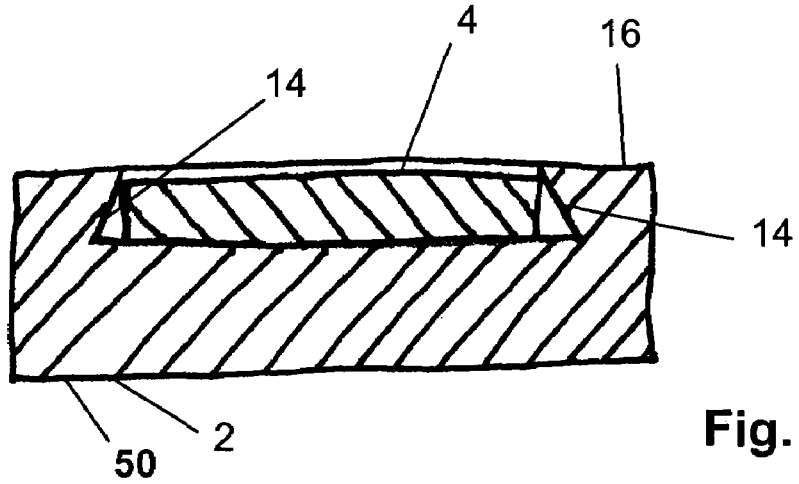
FIG. 7 is a cross section view showing a second means for retaining the medallion in the puck or model tire.

The first means for retaining the medallion 4 by puck 2 (FIG. 6) requires close tolerances between interior surface 14 of cavity 12 and exterior surface 10 of medallion 4 for a proper fit. FIG. 7 provides a second means for retaining medallion 4. Interior surface 14 of cavity 12 is sloped so that the opening of cavity 12 is smaller than the base of cavity 12. The purpose of the sloped interior surface 14 is to reduce the area of interior surface 14 in contact with medallion 4 while nonetheless providing positive retention of medallion 4. The resilient nature of the rubber puck 2 allows the puck 2 to be deformed and the medallion 4 to be removed. The slope of interior surface 14 shown in FIG. 7 is exaggerated for clarity.

Figure 8:
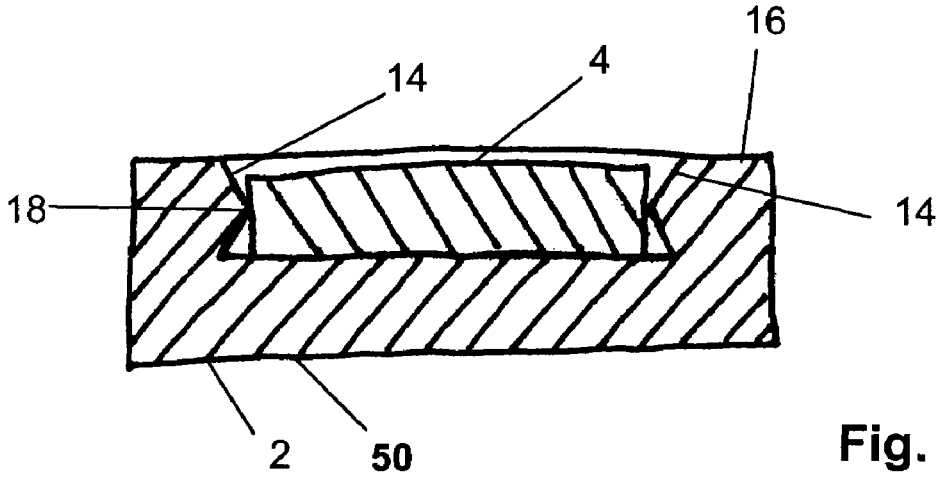
FIG. 8 is a cross section view showing a third means for retaining the medallion in the puck or model tire.

FIG. 8 shows a third means for retaining the medallion 4 in the puck 2. Interior surface 14 may define a high point 18 engaging the exterior surface 10 of medallion 4. As in FIG. 7, the purpose of the interior surface 14 configuration of FIG. 8 is to reduce the surface area of interior surface 14 in contact with medallion 4 while providing positive retention of medallion 4. The resilient nature of puck 2 allows a collector to deform puck 2, thereby deforming interior surface 14 and releasing medallion 4.

Figure 9:
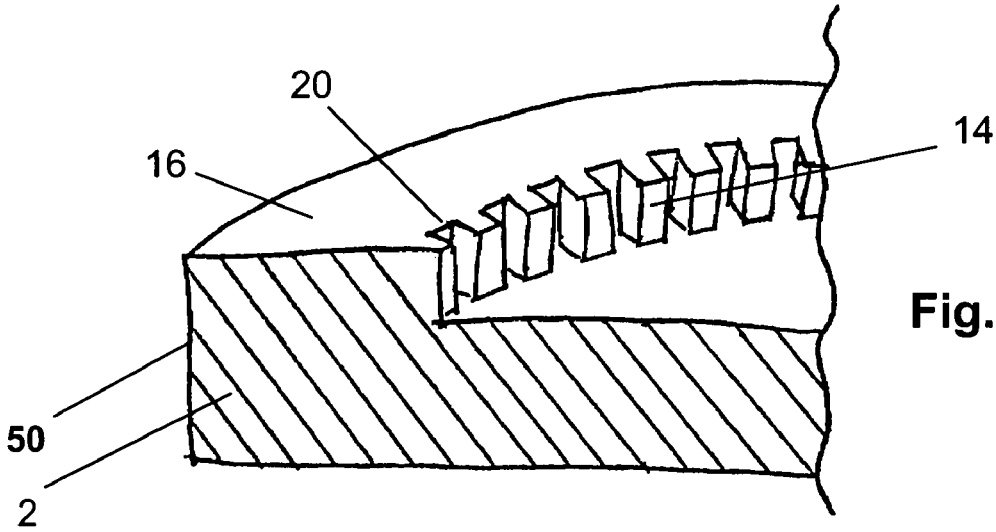
FIG. 9 is a detail of a perspective cross section showing a fourth means for retaining the medallion in the puck or model tire.
Figure 10:
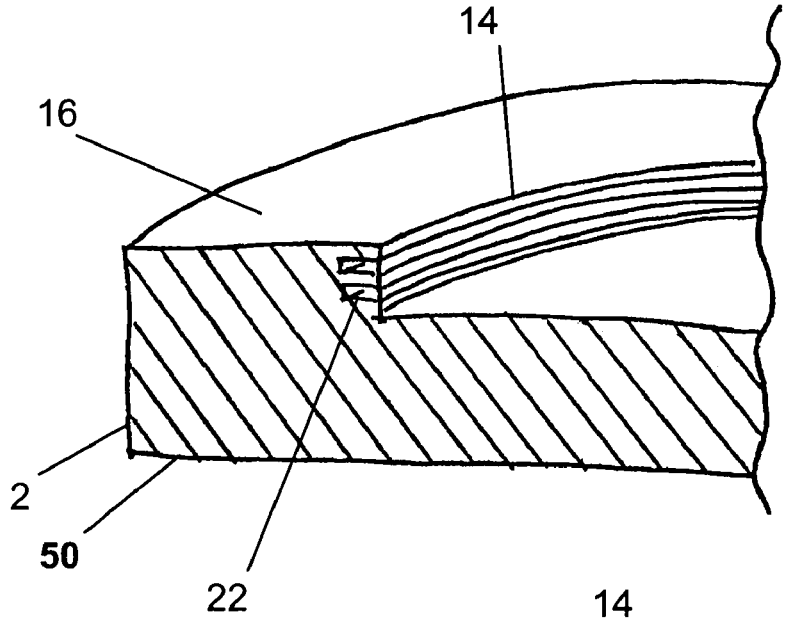
FIG. 10 is a detail of a perspective cross section showing a fifth means for retaining the medallion in the puck or model tire.
Figure 11:
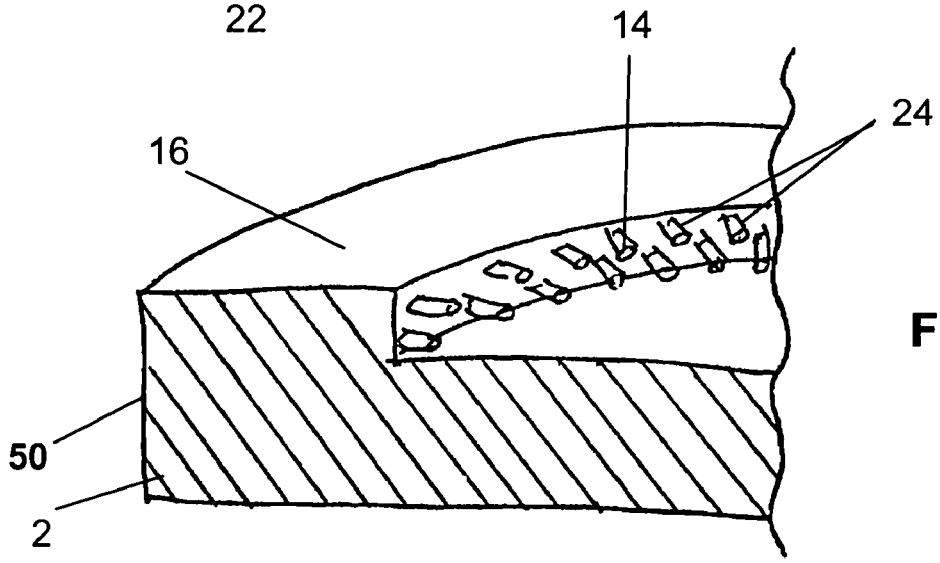
FIG. 11 is a detail of a perspective cross section showing a sixth means for retaining the medallion in the puck or model tire.

FIGS. 9-11 show fourth, fifth and sixth means for releasably retaining medallion 4 in cavity 12. In each of the means illustrated by FIGS. 9-11, the area of interior surface 14 of cavity 12 in contact with exterior surface 10 of medallion 4 is reduced. FIG. 9 illustrates vertical slots 20 normal to the front side 16 of puck 2 appearing in interior surface 14 of cavity 12. FIG. 10 illustrates horizontal slots 22 appearing in interior surface 14 of cavity 12. FIG. 11 illustrates protuberances 24 extending toward the center of puck 2 and defining interior surface 14.

FIGS. 6-11 show alternative designs for the interior surface 14 of cavity 12 that retain medallion 4 by compressing the resilient material from which puck 2 is formed. A common element shared by the alternatives illustrated by FIGS. 6-11 is that the amount of force exerted by the resilient material of puck 2 against medallion 4 may be adjusted by adjusting during the manufacturing process the amount of resilient material that will be compressed by medallion 4 when medallion 4 and puck 2 are engaged.

Figure 12:
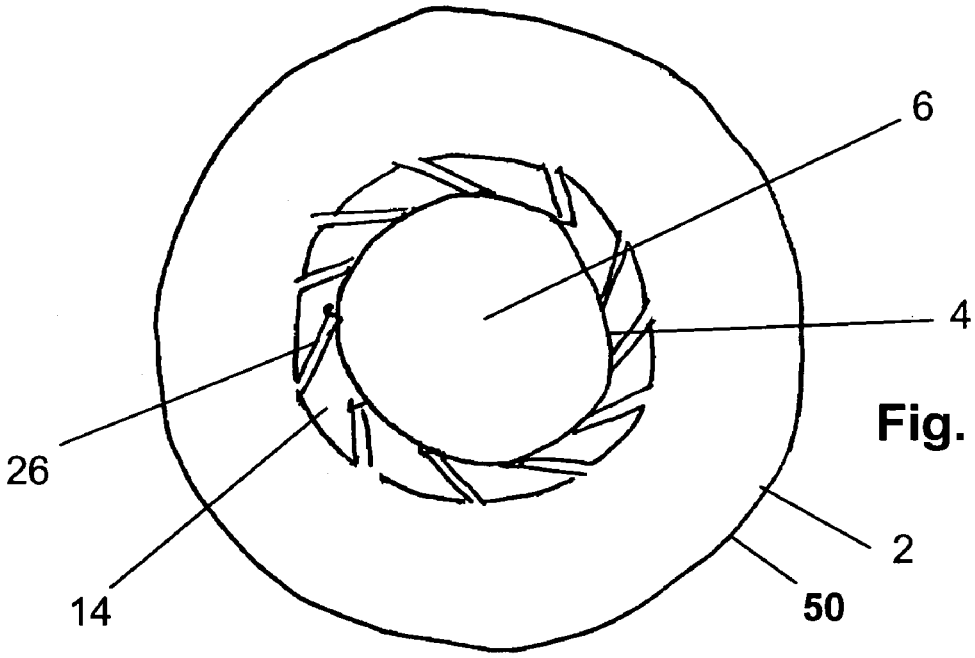
FIG. 12 is a plan view of a seventh means for releasably retaining the medallion in the puck or model tire.

FIG. 12 shows a seventh alternative means for retaining medallion 4 in cavity 12. In the alternative means illustrated by FIG. 12, arms 26 are formed of the resilient material during manufacture of puck 2. Engagement of medallion 4 by puck 2 flexes, rather than compresses, arms 26. The force exerted by arms 26 on the external surface 10 of medallion 4 is pre-selected by determining the number, dimensions, and material from which the arms 26 are composed.

Figure 13:
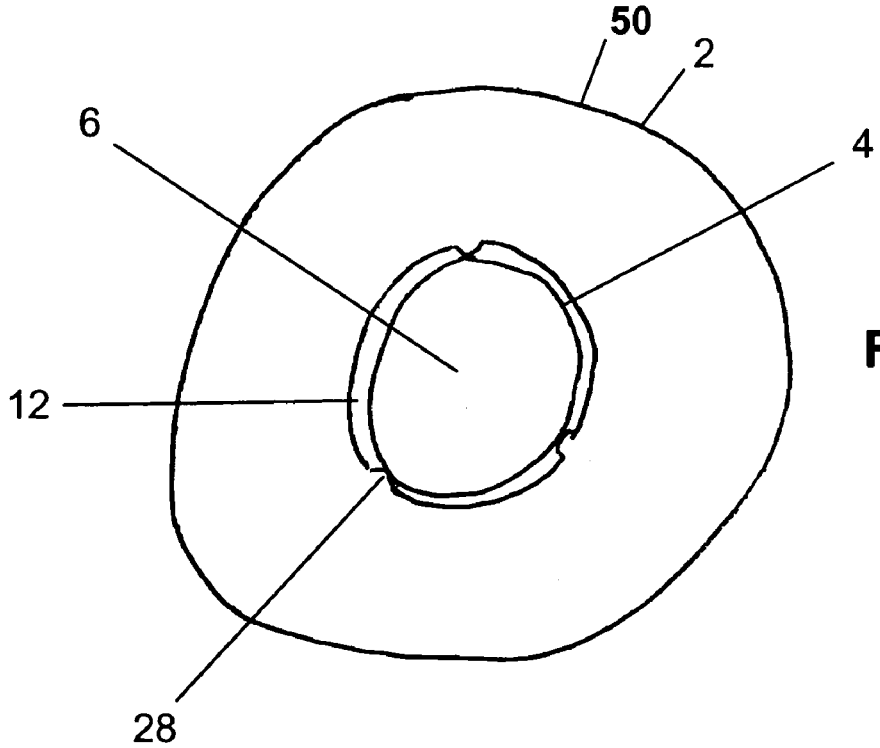
FIG. 13 is a plan view of an eighth means for releasably retaining the medallion in the puck or model tire.

FIG. 13 shows an eighth alternative means for retaining medallion 4 in cavity 12 that may be used in conjunction with any of the other means for retaining the medallion 4. The number of points of contact 28 between the interior surface 14 of cavity 12 and exterior surface 10 of medallion 4 may be selected to accurately locate medallion 4 with respect to puck 2 and to securely retain medallion 4. The number of points of contact 28 illustrated by FIG. 13 is three, though other values for the number of points of contact 28 may be used.

Figure 14:
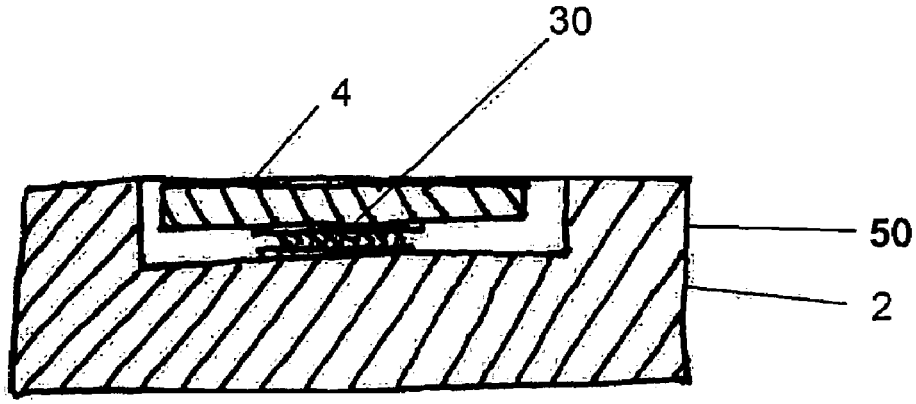
FIG. 14 is a cross section view showing a ninth means for retaining the medallion in the puck or model tire.

FIG. 14 shows a ninth means for releasably retaining medallion 4 in puck 2. In FIG. 14, one of the hook or the loop of hook-and-loop fastener 30 (such as Velcro™) is attached to the medallion 4 and the other of the hook or the loop is attached to the puck 2. Engagement of the hooks and loops of the hook-and-loop fastener 30 retains medallion 4, but allows medallion 4 to be released. The retention means illustrated by FIG. 12 does not depend on the resilient nature of the puck 2 for release of the medallion 4.

Figure 15:
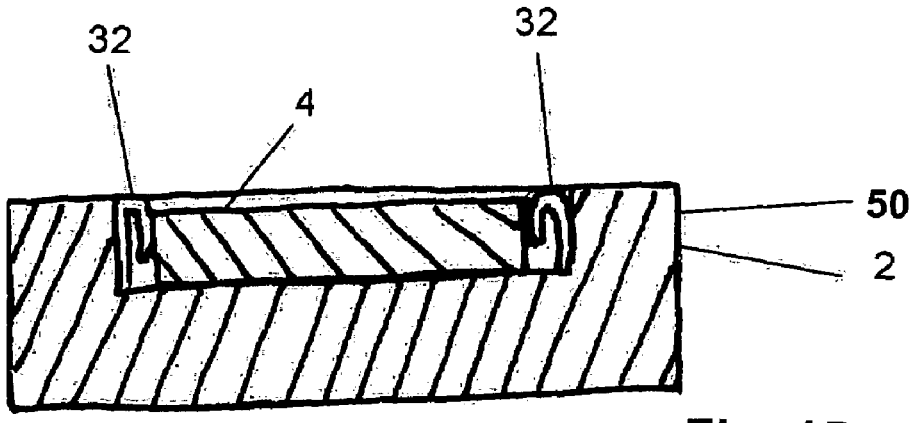
FIG. 15 shows a retaining member for holding the medallion in the puck or model tire.
Figure 16:
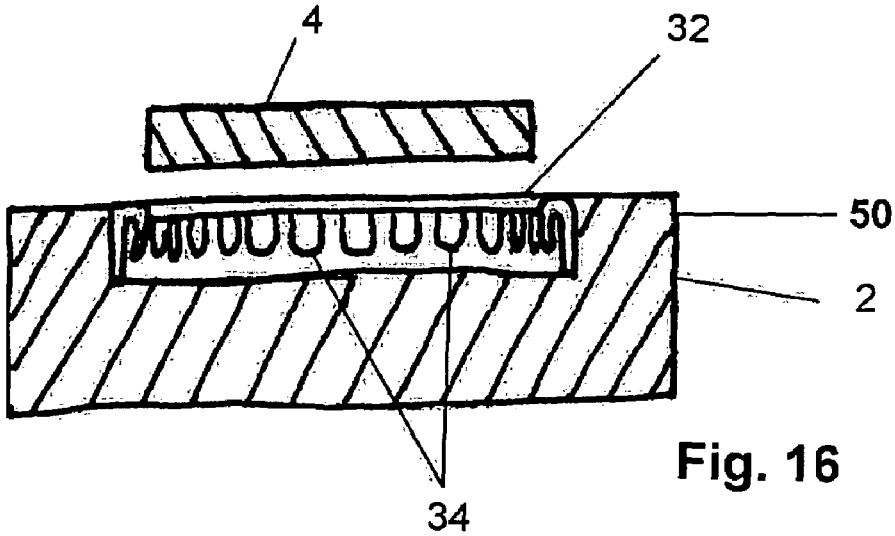
FIG. 16 is a cross section of the retaining member and puck or model tire with the medallion removed.
Figure 17:
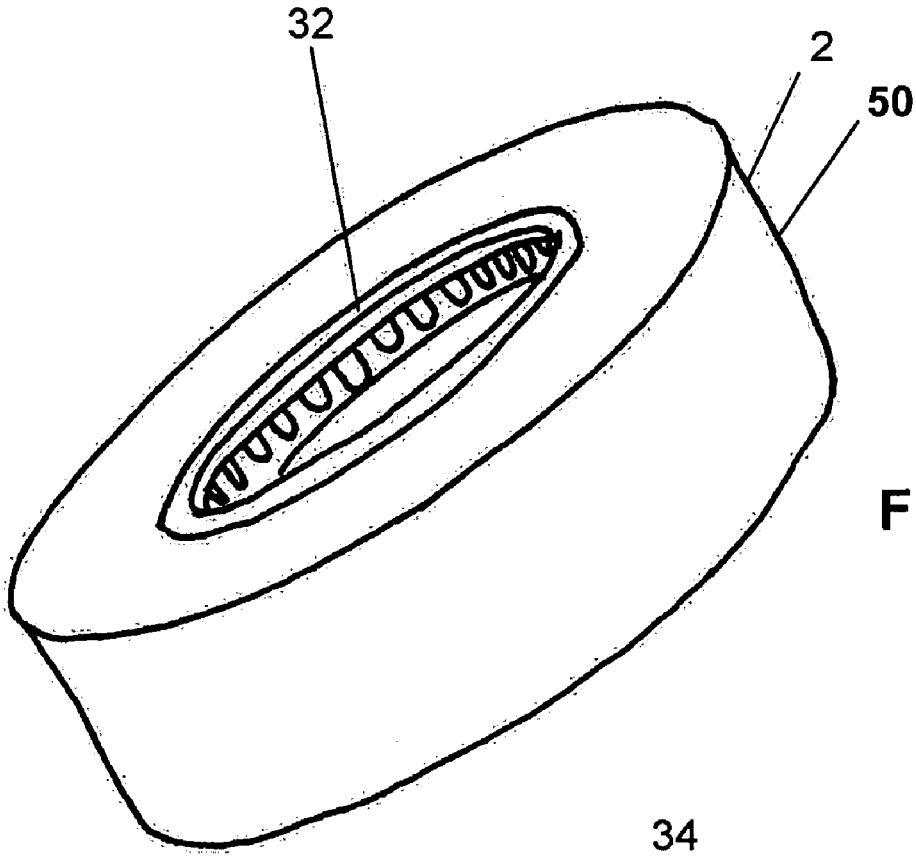
FIG. 17 is a perspective view of the retaining member and puck or model tire with the medallion removed.
Figure 18:
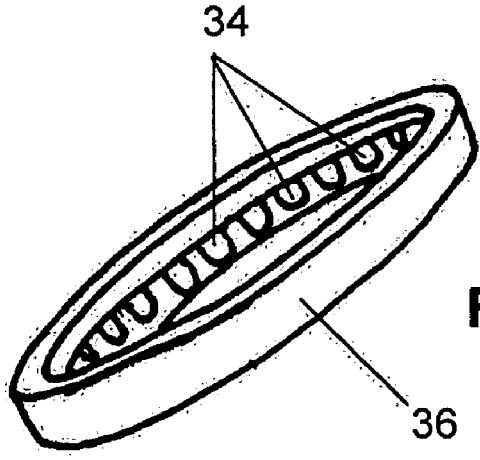
FIG. 18 is a perspective view of the retaining member.

FIGS. 15-18 illustrate a tenth means for retaining medallion 4 in puck 2 utilizing a retaining member 32 having springs 34. FIG. 15 shows the puck 2, retaining member 32 and medallion 4 assembly. FIG. 16 shows the puck 2 and retaining member 32 with medallion 4 removed. FIG. 17 is a perspective view of the puck 2 and retaining member 32, while FIG. 18 is a perspective view of the retaining member 32 alone.

Retaining member 32 has an outer body 36 (FIG. 18) and a plurality of springs 34 (FIGS. 16-18). Outer body 36 of retaining member 32 engages interior surface 14 of cavity 12 of puck 2 in an interference fit, the interior surface 14 thereby retaining the retaining member 14. Exterior surface 10 of medallion 4 engages the plurality of springs 34, retaining medallion 4 within the retaining member 32 and therefore within puck 2. The number and spring rate of springs 34 is selected so that medallion 4 is retained within retaining member 32 in normal handling, but so that medallion 4 can be removed and replaced by the collector.

Figure 19:
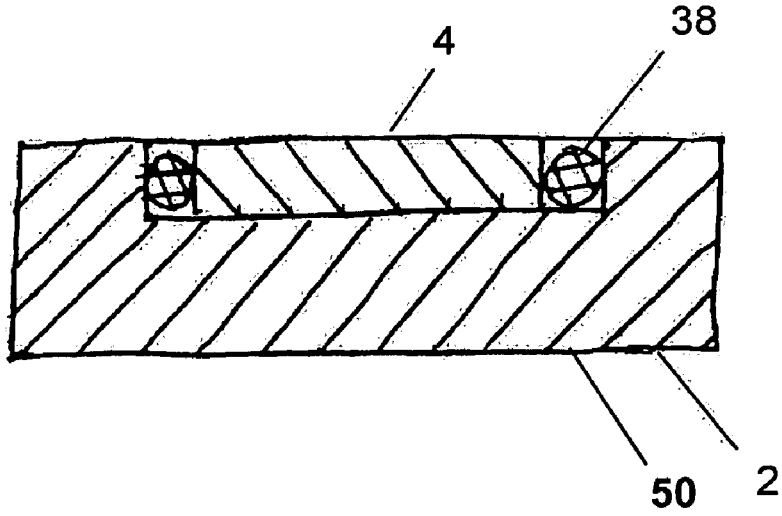
FIG. 19 is a cross section of a resilient retaining member.
Figure 20:
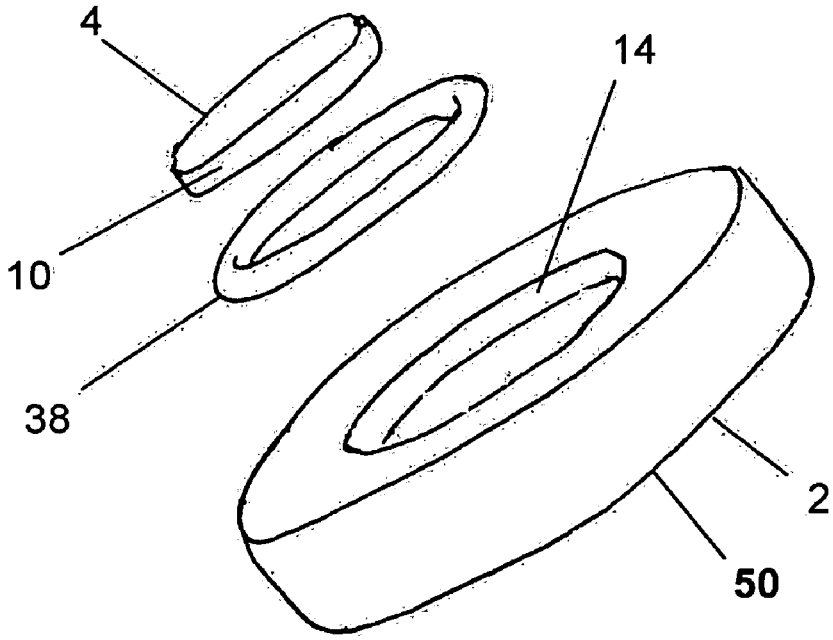
FIG. 20 is a perspective exploded view of the apparatus including a resilient retaining member.

FIGS. 19 and 20 illustrate an eleventh means for retaining medallion 4 in puck 2 utilizing a resilient retaining member 38. FIG. 20 is an exploded view showing puck 2, resilient retaining member 38 and medallion 4. FIG. 19 is a cross section view showing the puck 2 engaging the resilient retaining member 38 and the resilient retaining member 38 engaging the medallion 4. Compression of the resilient material of which the resilient retaining member 38 is composed holds the medallion 4 in place.

Figure 21:
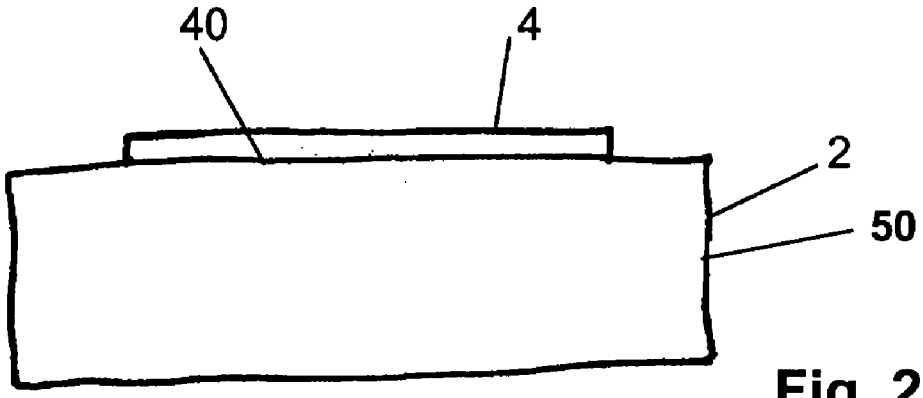
FIG. 21 is an additional means for attaching a medallion to a puck or model tire.

FIG. 21 shows a twelfth means for attaching a medallion 4 to a puck 2. An adhesive layer 40 bonds to puck 2 and bonds to medallion 4, securing medallion 4.

Figure 22:
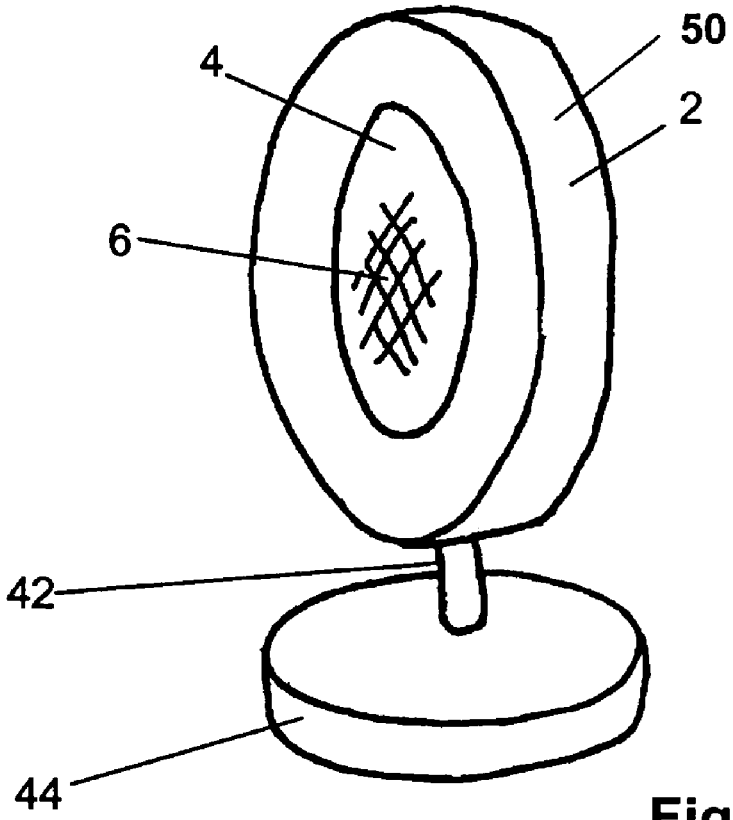
FIG. 22 is perspective view of a means for displaying the medallion and puck or model tire.

FIG. 22 shows a means for displaying the puck 2 and medallion 4 assembly. A pin 42 is supported by base 44. Pin 42 in turn engages a corresponding hole in puck 2, thereby supporting puck 2 and medallion 4.

Figure 23:
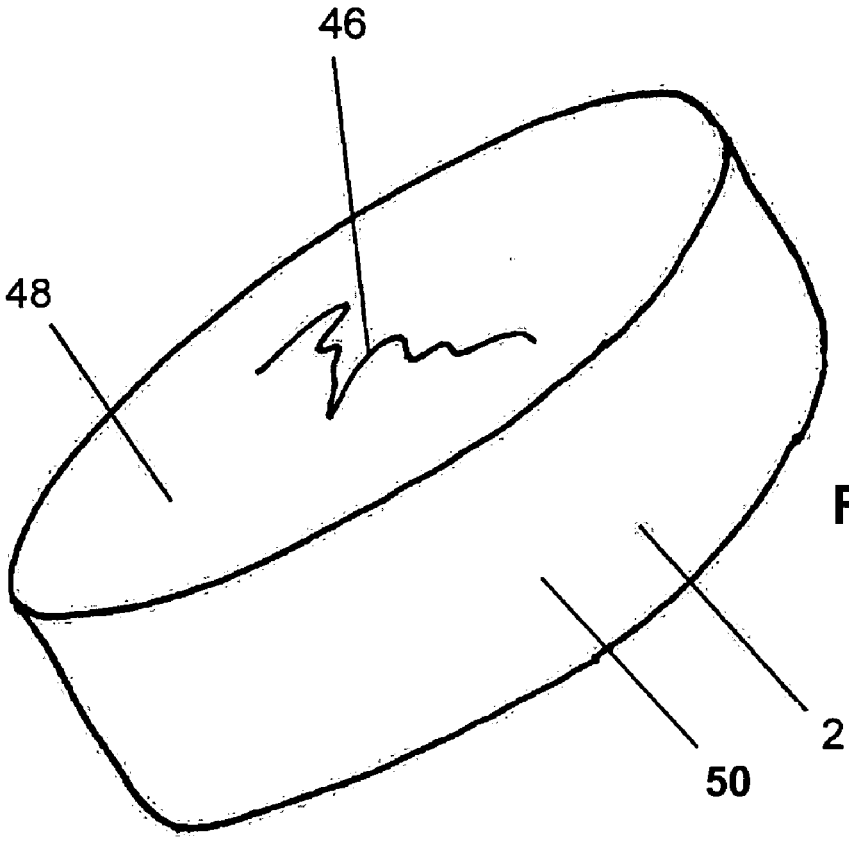
FIG. 23 is a perspective view of a reverse side of a puck or model tire of the Invention.

From FIG. 23, secondary indicia 46 may appear on puck 2 to render the puck 2 and medallion 4 combination more desirable to a fan or collector. For example, secondary indicia 46 may appear on the reverse side 48 of puck 2. Secondary indicia 46 may take the form of, for example, an autograph by a player. Such an autograph could be either placed on the puck 2 by the player or printed on the puck 2 using conventional printing means. Any secondary indicia 46 may be selected and secondary indicia 46 may appear anywhere on the puck 2, medallion 4, base 44 or pin 42.

Figure 24:
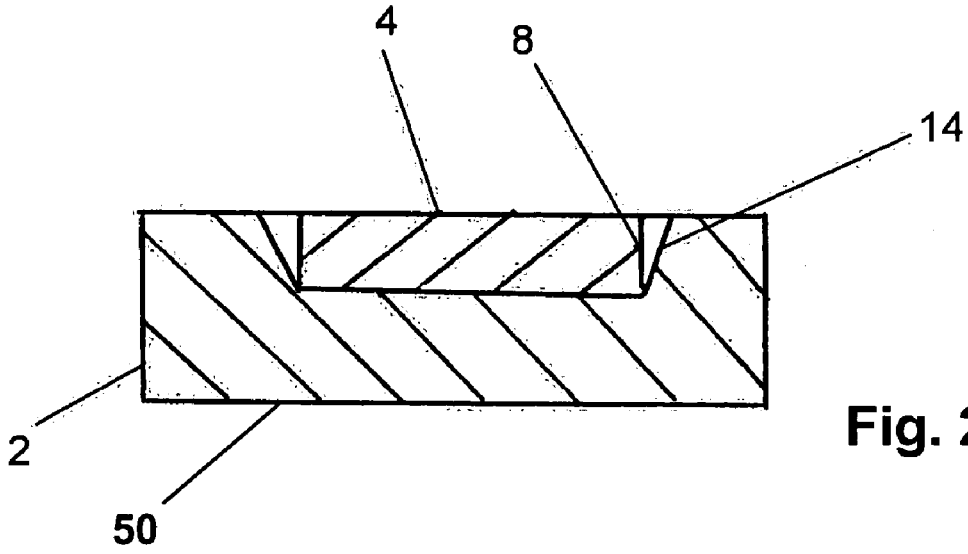
FIG. 24 is a thirteenth means for releasably retaining the medallion in a puck or model tire.

FIG. 24 illustrates a thirteenth alternative means for releasably retaining medallion 4 in puck 2. Exterior surface 14 of cavity 12 is relieved so that exterior surface 14 slopes outward. The slope of exterior surface 14 is exaggerated in FIG. 24 for clarity. The difference in diameter between the inner and outer portions of exterior surface 14 may be on the order of thousandths of an inch.

Figure 25:
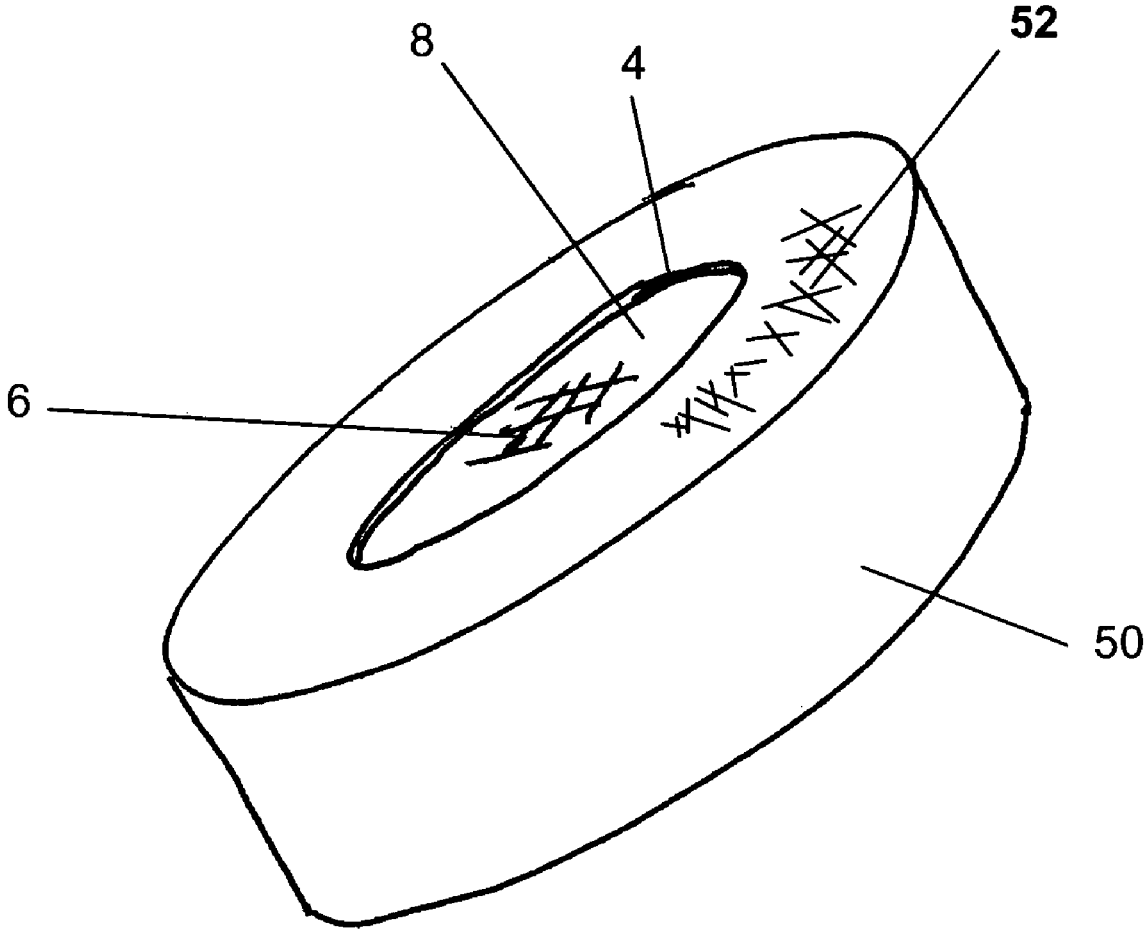
FIG. 25 is an application of the invention to a model of a tire.

As shown by FIG. 25, the holder for the medallion may take the form of a model of a tire 50, such as an automobile, motorcycle or truck tire, rather than that of a puck 2. The model of a tire 50 may bear visual cues 52, such as the name of a tire manufacturer, to indicate that the model 50 represents a tire. The model of a tire 50 may be a detailed scale model, may be a schematic model reminiscent of a tire only in overall shape, or may be some combination of a scale model and a schematic representation. Preferably the model of the tire 50 resembles a tire used in automobile racing.

The medallion 4 is releasably retained by the model tire 50 by the same means as for the puck 2 embodiment. As in the case of the puck 2, the model tire 50 preferably is composed of a hard rubber or another adequately resilient material to allow release of the medallion 4.

Each medallion has two display surfaces 8 on which indicia 6 appear. The model tire 50 is adapted to display only one side of the medallion 8, and hence only one display surface, at any one time. The model tire 50 may be solid with no center hole communicating through the model tire 50, as in the case of puck 2.

For the model tire 50 embodiment, the indica 6 selected for the first and second sides of medallion 4 are selected to appeal to persons interested in the particular vehicle, tire, or vehicle-related activity to which the model tire 50 applies. For example, if the model tire 50 is selected to resemble a tire used in NASCAR racing, the indicia 6 selected also preferably would relate to NASCAR racing. The indicia 6 may be selected to appeal to persons interested in any automobile-related or motor sports-related subject matter or any other subject matter that may appeal to the person. In all respects, the teachings above relating to the puck 2 embodiment apply equally to the tire model 50 embodiment.

In describing the above embodiments of the invention, specific terminology was selected for the sake of clarity. However, the invention is not intended to be limited to the specific terms so selected, and it is to be understood that each specific term includes all technical equivalents that operate in a similar manner to accomplish a similar purpose.

We claim:

1. A memorabilia apparatus comprising:

a. a rigid medallion, said medallion being in the shape of a substantially cylindrical solid, said medallion having a medallion diameter a peripheral external surface defining, a medallion thickness, a first medallion side and a second medallion side, said medallion thickness being small compared to said medallion diameter, said medallion having a first display surface defined by said first medallion side, said medallion having a second display surface defined by said second medallion side, said medallion being composed of a metal;

b. a model of a tire, said model of said tire being composed of a resilient material, said model of said tire having a tire thickness, said tire thickness being equal to or greater than twice said medallion thickness;

c. means for said model of said tire to releasably engage said medallion, said means for said model of said tire to releasably engage said medallion selectably exhibiting one of said first and said second display surfaces when said medallion and said model of said tire are engaged, said means for said model of said tire to releasably engage said medallion selectably covering the other of said first and said second display surfaces when said medallion and said model of said tire are engaged, said means for said model of said tire to releasably engage said medallion comprising: said model of said tire defining a cavity, said cavity having an interior surface, said interior surface releasably engaging said medallion;

d. first indicia, said first indicia appearing on said first display surface of said medallion e. second indicia appearing on said second display surface of said medallion, said means for said model of said tire to releasably engage said medallion further comprising: said interior surface of said cavity having an interior dimension, said peripheral external surface having an external dimension, said external dimension and said internal dimension being selected so that said interior surface of said cavity exerts a pre-selected force against said peripheral external surface of said medallion when said model of said tire and said medallion are engaged.

2. The apparatus of claim 1 wherein said model of said tire defines a front side, said front side defining said cavity, the apparatus further comprising: a visual cue appearing on said front side, said visual cue being indicia to identify said model as a tire.

3. A memorabilia apparatus comprising:

a. a rigid medallion, said medallion being in the shape of a substantially cylindrical solid, said medallion having a diameter, a thickness, a first side and a second side, said thickness of said medallion being small compared to said diameter of said medallion, said medallion having a first display surface defined by said first side of said medallion, said medallion having a second display surface defined by said second side of said medallion, said medallion being composed of a metal ;

b. a model of a tire, said model of said tire being composed of a resilient material;

c. means for said model of said tire to releasably engage said medallion, said means for said model of said tire to releasably engage said medallion selectably exhibiting one of said first and said second display surfaces when said medallion and said model of said tire are engaged, said means for said model of said tire to releasably engage said medallion selectably covering the other of said first and said second display surfaces when said medallion and said model of said tire are engaged, said means for said model of said tire to releasably engage said medallion comprising: said model of said tire defining a cavity, said cavity having an interior surface, said interior surface releasably engaging said medallion;

d. first indicia, said first indicia appearing on said first display surface of said medallion e. second indicia appearing on said second display surface of said medallion, said means for said model of said tire to releasably engage said medallion further comprising: said interior surface of said cavity having an interior dimension, said medallion having an external surface, said external surface having an external dimension, said external dimension and said internal dimension being selected so that said interior surface of said cavity exerts a pre-selected force against said external surface of said medallion when said model of said tire and said medallion are engaged, said means for said model of said tire to releasably engage said medallion further comprising: said external surface of said medallion engaging said interior surface of said cavity at an annular area of contact, said interior surface of said cavity defining substantially a triangle in cross section, said triangle in cross section having an apex, said apex defining said annular area of contact, said annular area of contact exerting said pre-selected force against said external surface of said medallion when said model of said tire and said medallion are engaged.

4. The apparatus of claim 3, further comprising: secondary indicia appearing on said model of said tire.

5. The apparatus of claim 4, further comprising: means for displaying said model of said tire and said medallion engaging said model of said tire.

* * * * *